US008147037B2

(12) United States Patent
Park et al.

(10) Patent No.: US 8,147,037 B2
(45) Date of Patent: Apr. 3, 2012

(54) INKJET PRINTHEAD AND METHOD OF MANUFACTURING THE SAME

(75) Inventors: Byung-Ha Park, Suwon-Si (KR); Young-Ung Ha, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 373 days.

(21) Appl. No.: 12/565,038

(22) Filed: Sep. 23, 2009

(65) Prior Publication Data

US 2010/0118088 A1 May 13, 2010

(30) Foreign Application Priority Data

Nov. 7, 2008 (KR) ..... 10-2008-0110493

(51) Int. Cl.
*B41J 2/14* (2006.01)

(52) U.S. Cl. ..... 347/47

(58) Field of Classification Search ..... 347/47, 347/40, 42, 44, 49, 54, 56, 61, 63, 64, 65, 347/20

See application file for complete search history.

(56) References Cited

U.S. PATENT DOCUMENTS

| | | | | |
|---|---|---|---|---|
| 6,409,316 | B1 * | 6/2002 | Clark et al. | 347/63 |
| 7,204,574 | B2 * | 4/2007 | Bertelsen et al. | 347/20 |
| 2008/0122895 | A1 * | 5/2008 | Hart et al. | 347/47 |

* cited by examiner

*Primary Examiner* — Kristal Feggins
(74) *Attorney, Agent, or Firm* — Staas & Halsey LLP

(57) ABSTRACT

Provided are an inkjet printhead and a method of manufacturing the same. The inkjet printhead includes a substrate which includes an ink feed passage, a chamber layer, which is disposed on the substrate and a plurality of ink chambers in which ink supplied from the ink feed passage is filled. It also includes a nozzle layer, which is disposed in the chamber layer and includes a plurality of nozzles through which the ink is ejected. The chamber layer and the nozzle layer are cured products of a first negative photoresist composition and a second negative photoresist composition. Each of the first negative photoresist composition and the second negative photoresist composition includes an epoxidized multifunctional bisphenol B novolak resin, a cationic optical initiator, and a solvent.

20 Claims, 17 Drawing Sheets

INKJET PRINTHEAD AND METHOD OF MANUFACTURING THE SAME

CROSS-REFERENCE TO RELATED PATENT APPLICATION

This application claims the benefit of Korean Patent Application No. 10-2008-0110493, filed on Nov. 7, 2008, in the Korean Intellectual Property Office, the disclosure of which is incorporated by reference herein in its entirety.

TECHNICAL FIELD

The disclosure relates to inkjet printing. In particular, it is a thermal inkjet printhead and a method of manufacturing the same.

BACKGROUND

An inkjet printhead is an apparatus for forming an image of a predetermined color by ejecting minute droplets on a desired location of a printing medium. Such an inkjet printhead may be classified into two types according to the mechanism of ejecting ink droplets. One type is a thermal inkjet printhead, which generates bubbles in ink by using a heat source and ejects ink droplets by using an expansive force of the generated bubbles. Another type is a piezoelectric inkjet printhead, which ejects ink droplets by using pressure applied to ink due to deformation of a piezoelectric element.

In the thermal inkjet printhead, when a pulse current flows in a heater formed of a resistance-heating element, heat is generated in the heater, and ink, adjacent to the heater, is quickly heated to about 300° C. Bubbles are generated as the ink boils. The bubbles expand thereby pressurizing the ink filled in the ink chamber. Consequently, the ink is ejected outside the ink chamber in droplets via a plurality of nozzles.

A thermal inkjet printhead may have a structure in which a chamber layer and a nozzle layer are sequentially stacked on a substrate on which a plurality of material layers are formed. The chamber layer includes a plurality of ink chambers filled with ink to be ejected, and the nozzle layer includes a plurality of nozzles that eject ink. Also, an ink feed hole or passage for supplying ink to the ink chambers is formed through and penetrates the substrate.

SUMMARY

We provide an inkjet printhead. The printhead comprises a substrate having at least one ink feed passage and a chamber layer disposed above the substrate. The chamber layer comprises at least one ink chamber in communication with the ink feed passage. Also included is a nozzle layer disposed above the chamber layer. The nozzle layer comprises at least one nozzle in communication with the ink chamber. The nozzle is configured to eject ink. The chamber layer comprises the cured product of a first negative photoresist composition. The nozzle layer comprises the cured product of a second negative photoresist composition. The first negative photoresist composition and the second negative photoresist composition comprise an epoxidized multifunctional bisphenol B novolak resin, a cationic optical initiator and a solvent.

We also provide a method of manufacturing an inkjet printhead. The method comprises forming a chamber layer on a substrate by curing a first negative photoresist composition comprising an epoxidized multifunctional bisphenol B novolak resin, a cationic optical initiator, and a solvent. A nozzle layer is formed by curing a second negative photoresist composition comprising an epoxidized multifunctional bisphenol B novolak resin, a cationic optical initiator, and a solvent. The nozzle layer comprises a plurality of nozzles. An ink feed passage is formed in a rear surface of the substrate. An ink chamber and a restrictor each in communication with the ink feed passage, are formed.

We also provide another method of manufacturing an inkjet printhead. The method comprises providing a substrate and providing at least one chamber material layer above the substrate. The chamber material layer comprises a first negative photoresist composition comprised of an epoxidized multifunctional bisphenol B novolak resin, a cationic optical initiator, and a solvent. At least one exposure portion of the chamber material layer and at least one non-exposure portion of the chamber material layer are formed. At least one chamber layer having at least one ink chamber is formed by removing the non-exposure portion. At least one nozzle material layer is formed above the chamber layer. The nozzle material layer comprises at least one second photoresist composition comprised of an epoxidized multifunctional bisphenol B novolak resin, a cationic optical initiator, and a solvent. At least one exposure portion of the nozzle material layer and at least one non-exposure portion of the nozzle material layer are formed. At least one nozzle layer having at least one nozzle in communication with the chamber is formed by removing the non-exposure portion. At least one ink feed passage is formed in the substrate such that the ink feed passage is in communication with the at least one chamber.

BRIEF DESCRIPTION OF THE DRAWINGS

The above and other features and advantages will become more apparent by describing in detail examples thereof with reference to the attached drawings in which:

FIG. 3 is a cross-sectional view of a substrate of an inkjet printhead having various layers thereon.

FIG. 4 is a is a cross-sectional view of the substrate shown in FIG. 3 with a chamber material layer.

FIG. 5 is a cross-sectional view of the substrate shown in FIG. 4 after exposure and PEB processes have been performed on the chamber material layer.

FIG. 6 is a cross-sectional view of the substrate shown in FIG. 5 with a sacrificial layer.

FIG. 7 is a cross-sectional view of the substrate shown in FIG. 6 after the sacrificial layer and chamber layer have undergone a planarization process.

FIG. 8 is a cross-sectional view of the substrate shown in FIG. 7 with a nozzle material layer.

FIG. 9 is a cross-sectional view of the substrate shown in FIG. 8 after the nozzle material layer has undergone an exposure process.

FIG. 10 is a cross-sectional view of the substrate shown in FIG. 9 with a nozzle layer formed over the sacrificial layer.

FIG. 11 is a cross-sectional view of the substrate shown in FIG. 10 with an etching mask.

FIG. 12 is a cross-sectional view of the substrate shown in with an ink feed passage.

FIG. 13 is a cross-sectional view of an inkjet printhead of the disclosure.

DETAILED DESCRIPTION

Figure 1:
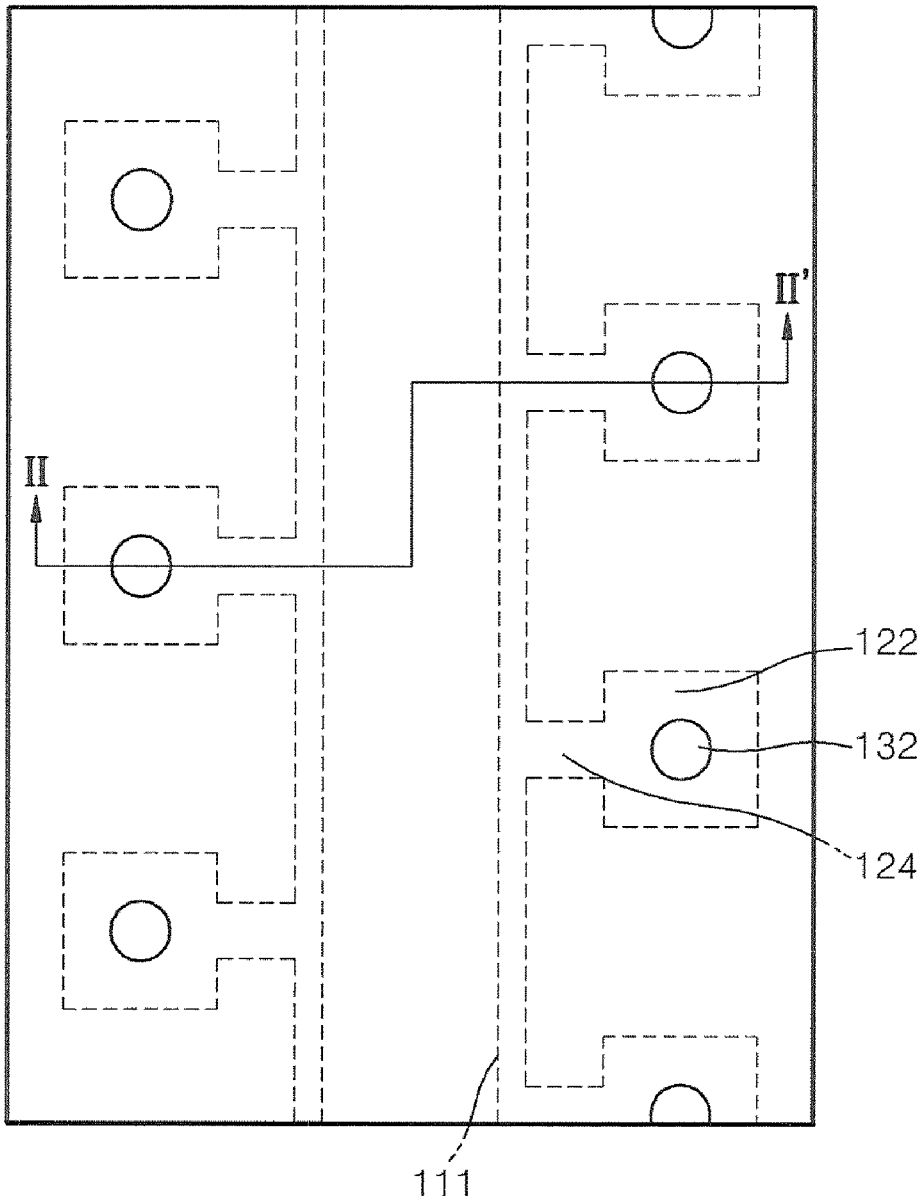
FIG. 1 is a plan view schematically illustrating an inkjet printhead.

The disclosure will now be described more fully with reference to the accompanying drawings, in which representative examples are shown. In the drawings, like reference numerals denote like elements, and the sizes and thicknesses of elements may be exaggerated for clarity. It will also be understood that when a layer is referred to as being "on" or "above" another layer or substrate, it can be directly on the other layer or substrate, or intervening layers may also be present.

Figure 2:
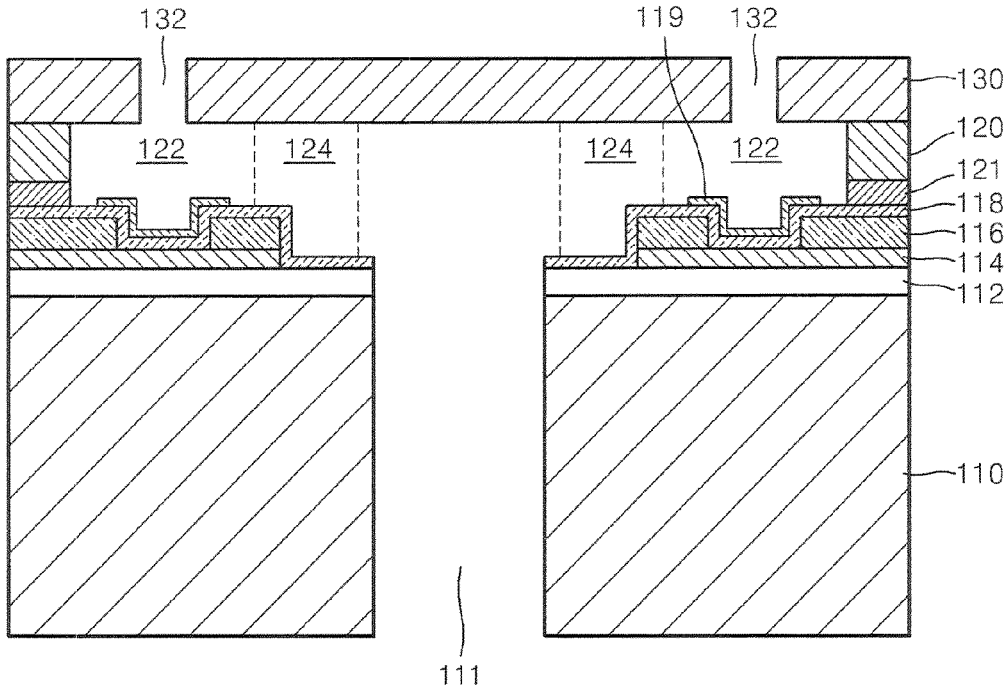
FIG. 2 is a cross-sectional view taken along a line II-II' of FIG. 1.

FIG. 1 is a plan view schematically illustrating an inkjet printhead according to an embodiment of the disclosure. FIG. 2 is a cross-sectional view taken along a line II-II' of FIG. 1.

Referring to FIGS. 1 and 2, an inkjet printhead may include a chamber layer 120 and a nozzle layer 130 sequentially formed on a substrate 110 on which a plurality of material layers are formed. The substrate 110 may be formed of silicon. An ink feed passage or hole 111 for supplying ink is formed by penetrating the substrate 110, preferably at a bottom portion of the substrate.

An insulation layer 112 for insulation and isolation may be formed between the substrate 110 and a heater 114. The insulation layer 112 and heater 114 are above or on a top surface of the substrate 110. The insulation layer 112 may be formed of a silicon oxide. The heater 114, which generates bubbles by heating ink in an ink chamber 122, is formed on the top surface of the insulation layer 112. The heater 114 may form a bottom surface of the ink chamber 122. The heater 114 may be formed of a heating resistor, such as a tantalum-aluminium alloy, a tantalum nitride, a titanium nitride, or a tungsten silicide, but is not limited thereto.

An electrode 116 is formed on a top surface of the heater 114. The electrode 116 supplies a current to the heater 114 and is formed of a material having excellent electrical conductivity. The electrode 116 may be formed of aluminium (Al), an aluminium alloy, gold (Au), or silver (Ag), but is not limited thereto.

A passivation layer 118 may be formed on top surfaces of the heater 114 and the electrode 116. The passivation layer 118 prevents the heater 114 and the electrode 116 from being oxidized or corroded by contacting the ink, and may be formed of a silicon nitride or a silicon oxide. Also, an anti-cavitation layer 119 may be further formed on a top surface of the passivation layer 118, which is disposed above or on the top surface of the heater 114. The anti-cavitation layer 119 protects the heater 114 from a cavitation force generated when the bubbles disappear. The anti-cavitation layer 119 may be formed of tantalum (Ta).

A glue layer 121 may be formed on the passivation layer 118. This layer adheres the chamber layer 120 to the passivation layer 118. The inclusion of the glue layer 121 is optional. The glue layer 121 may be used to attach the substrate 110, which may include the insulation layer 112, the heater 114, the electrode 116, and the passivation layer 118 to the chamber layer 120. The glue layer 121 may be disposed between the passivation layer 118 and the chamber layer 120. The glue layer 121 is formed by coating a photosensitive composition, such as SU-8 (MicroChem Corporation) of low viscosity, on the substrate 110 and then forming a predetermined pattern via a photolithography process.

The chamber layer 120 is formed of a first negative photoresist composition. The chamber layer 120 may be formed on the glue layer 121. If the glue layer 121 is omitted, the chamber layer 120 may be directly formed on the top surface of the substrate 110 or may be formed on the top surface of the passivation layer 118.

A plurality of ink chambers 122 are formed in the chamber layer 120. The ink chambers 122 house ink supplied from the ink feed hole 111. A plurality of restrictors 124, constituting paths connecting the ink feed hole 111 and the ink chambers 122, may be formed in the chamber layer 120. The chamber layer 120 may be formed by forming a chamber material layer (120' in FIG. 4) including the first negative photoresist composition on the glue layer 121, and then patterning the chamber material layer via a photolithography process.

The first negative photoresist composition may be formed of a negative type photosensitive polymer. Non-exposure portions of the first negative photoresist composition may be removed by using a predetermined developer so as to form the plurality of ink chambers 122 and restrictors 124. Also, exposure portions of the first negative photoresist composition form a cross-linked structure via a post exposure bake (PEB) process, so as to form the chamber layer 120.

The nozzle layer 130 is formed of a second negative photoresist composition and is formed on the chamber layer 120. A plurality of nozzles 132, through which ink is ejected, are formed in the nozzle layer 130. The nozzle layer 130 is formed by forming a nozzle material layer (130' in FIG. 8) including the second negative photoresist composition, and then patterning the nozzle material layer via a photolithography process.

The second negative photoresist composition may be formed of a negative type photosensitive polymer. Non-exposure portions of the second negative photoresist composition may be removed as described later so as to form the plurality of nozzles 132. Also, exposure portions of the second negative photoresist composition form a cross-linked structure via a PEB process, so as to form the nozzle layer 130. The forming of the chamber layer 120 and the nozzle layer 130 will be described later in detail.

The first and second negative photoresist compositions include a glycidyl ether functional group on a monomer repetition unit and may also include a prepolymer having a bisphenol-B-based skeleton, i.e. an epoxidized multifunctional bisphenol B novolak resin, a cationic optical initiator and a solvent. The first and second negative photoresist compositions may be the same or different. The prepolymer in the first and second negative photoresist compositions may form a cross-linked polymer by being exposed to actinic rays.

The epoxidized multifunctional bisphenol B novolak resin may be represented by Formula 1 below:

(1)

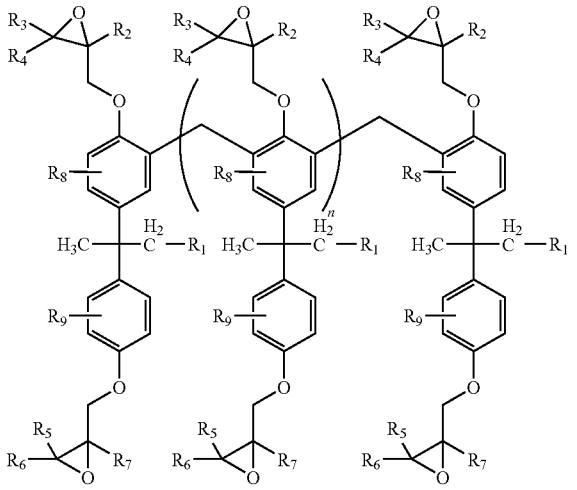

Here, n is an integer in a range of 1 to 20, $R_1$ is a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group. $R_2$ through $R_9$ are each independently a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

In detail, the epoxidized multifunctional bisphenol B novolak resin may be represented by Formula 2 below:

(2)

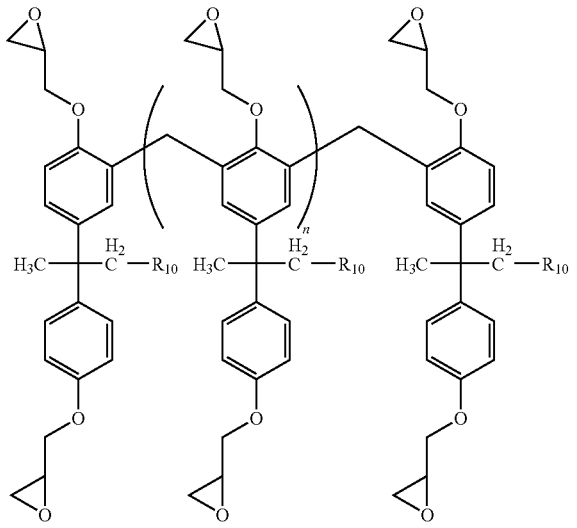

Here, n is an integer in a range of 1 to 20. $R_{10}$ is a halogen atom, a hydroxy group, a substituted or unsubstituted $C_1$-$C_{20}$ alkyl group, a substituted or unsubstituted $C_1$-$C_{20}$ carboxyl group, or a substituted or unsubstituted $C_1$-$C_{20}$ alkylsiloxane group.

Due to an asymmetric molecular structure, the epoxidized multifunctional bisphenol B novolak resin has an amorphous characteristic. Therefore, it has improved flexibility and a coating abilities compared to a conventional bisphenol A novolak resin, and forms a layer that generally, does not crack.

In other words, in Formula 1 and Formula 2, substituents $R_1$ and $R_{10}$ have a function of providing asymmetry to a molecular structure. $R_1$ and $R_{10}$ and may be an alkyl group such as a methyl group, a halogen atom or halogen atom substituted alkyl group (for example, a fluoroalkyl group or the like), a hydroxy group or alcohol or ester group having a hydroxy group, or an alkylsiloxane group, but are not limited thereto.

The alkyl group such as a methyl group provides flexibility to a cured product of the epoxidized multifunctional bisphenol B novolak resin, and thus prevents the formation of cracks generated after development. Also, the halogen atom or halogen atom substituted alkyl group, which are generally hydrophobic, and the hydroxy group or alcohol group or ester group having the hydroxy group, which are generally hydrophilic, may control the humidity of the cured product of the epoxidized multifunctional bisphenol B novolak resin, in addition to preventing cracks.

The alkylsiloxane group adds an inorganic substance to the cured product, which is an organic substance, and thus mechanical properties of the cured product are improved.

The epoxidized multifunctional bisphenol B novolak resin may result from a reaction of bisphenol B novolak resin and epichlorohydrin. The bisphenol B novolak resin may be obtained by condensation-reacting a bisphenol B-based compound and aldehyde-based and/or ketone-based compound by using an acid catalyst.

The bisphenol B-based compound may be represented by Formula 3 below:

(3)

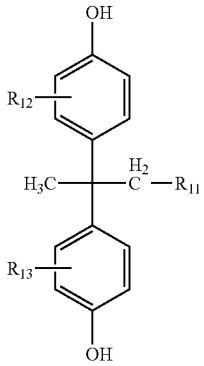

$R_{11}$ is a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group. $R_{12}$ and $R_{13}$ are each, independently, a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

As a detailed example, $R_{11}$ of the bisphenol B-based compound may be an alkyl group such as a methyl group, a halogen atom or halogen atom substituted alkyl group (for example a fluoroalkyl group), a hydroxy group or an alcohol group or ester group having the hydroxy group, or an alkylsiloxane group, which may be used independently or in a mixture thereof.

The aldehyde-based compound may be formaldehyde, formalin, paraformaldehyde, trioxane, acetaldehyde, propylaldehyde, benzaldehyde, phenylacetaldehyde, alpha-phenylpropylaldehyde, beta-phenylpropylaldehyde, o-hydroxybenzaldehyde, m-hydroxybenzaldehyde, p-hydroxybenzaldehyde, o-chlorobenzaldehyde, m-chlorobenzaldehyde, p-chlorobenzaldehyde, o-methylbenzaldehyde, m-methylbenzaldehyde, p-methylbenzaldehide, p-ethylbenzaldehyde, p-n-butylbenzaldehyde, or terephthalic acid aldehyde, which may be used independently or in a mixture thereof.

The ketone-based compound may be acetone, methylethylketone, diethylketone, or diphenylketone, which may be used independently or in a mixture thereof.

The cationic optical initiator included in the first and second negative photoresist compositions may generate ions or free radicals initiating polymerization during a general light exposure.

Examples of the cationic optical initiator include an aromatic halonium salt of a VA and VI element, such as UVI-6974 manufactured by Union Carbide, and an aromatic sulfonium salt of a VA and VI element, such as SP-172 manufactured by Asahi Denka.

The aromatic halonium salt may be an aromatic iodonium salt; detailed examples of which include diphenyliodonium tetrafluoroborate, diphenyliodonium hexafluoroantimonate, and butylphenyliodonium hexafluoroantimonate (SP-172), but are not limited thereto.

Detailed examples of the aromatic sulfonium salt include triphenylsulfonium tetrafluoroborate, triphenylsulfonium hexafluoroantimonate (UVI-6974), phenylmethylbenzilsulfonium hexafluoroantimonate, phenylmethylbenzilsulfonium hexafluorophosphate, triphenylsulfonium hexafluorophosphate, methyl diphenylsulfonium tetrafluoroborate, and dimethyl phenylsulfonium hexafluorophosphate.

The amount of the cationic optical initiator may be in a range of about 1 to about 10 parts by weight or about 1.5 to about 5 parts by weight based on 100 parts by weight of the epoxidized multifunctional bisphenol B novolak resin. If the amount of the cationic optical initiator is less than about 1 part by weight based on 100 parts by weight of the epoxidized Multifunctional bisphenol B novolak resin, a sufficient crosslinking reaction may not be obtained. If the amount of the cationic optical initiator is greater than 10 parts by weight based on 100 parts by weight of the epoxidized multifunctional bisphenol B novolak resin, an unnecessarily high amount of light energy is required and, thus, crosslinking speed may be decreased.

The solvent used in the first and second negative photoresist compositions may include at least one of the group consisting of alpha-butyrolactone, gamma-butyrolactone, propylene glycol methyl ethyl acetate, tetrahydrofuran, methyl ethyl ketone, methyl isobutyl ketone, cyclopentanon, and xylene.

The amount of the solvent may be in a range of about 30 to 300 parts by weight or about 50 to 200 parts by weight based on 100 parts by weight of the epoxidized multifunctional bisphenol B novolak resin. If the amount of the solvent is less than about 30 parts by weight based on 100 parts by weight of the epoxidized multifunctional bisphenol B novolak resin, viscosity of the first and second negative photoresist compositions increases and, thus, workability deteriorates. If the amount of the solvent is greater than about 300 parts by weight based on 100 parts by weight of the epoxidized multifunctional bisphenol B novolak resin, viscosity of the first and second negative photoresist compositions decreases and, thus, it may be difficult to form patterns.

The first and second negative photoresist compositions may further include a plasticizer. The plasticizer prevents cracks from being generated in the nozzle layer 130 after nozzle development and sacrificial layer removal during a nozzle forming process. The plasticizer also improves inferior resolution caused by Y spacing because it reduces deviation of overall nozzle slope. Such effects occur because of a reduction in the stress of the nozzle layer 130 due to the plasticizer, which has a high boiling point. The plasticizer operates as a lubricant in cross-linked molecules. Moreover, with the plasticizer, an additional baking process may be omitted and, thus, the process of manufacturing the thermal inkjet printhead may be simplified.

The plasticizer may be phthalic acid-based, trimellitic acid-based, or phosphite-based, and the phthalic acid-based plasticizer may be dioctyl phthalate (DOP) or diglycidyl hexahydro phthalate (DGHP), but is not limited thereto. The trimellitic acid-based plasticizer may be triethylhexyl trimellitate, and the phosphite based plasticizer may be tricrecyl phosphate. The phthalic acid-based, trimellitic acid-based, or phosphite-based plasticizer may be used alone or in combination of at least two.

The amount of the plasticizer may be in a range of about 1 to 15 parts by weight or about 5 to 10 parts by weight based on 100 parts by weight of the epoxidized multifunctional bisphenol B novolak resin. If the amount of the plasticizer is less than about 1 part by weight based on 100 parts by weight of the epoxidized multifunctional bisphenol B novolak resin, the effects of the plasticizer may be insignificant. If the amount of the plasticizer is greater than about 15 parts by weight based on 100 parts by weight of the epoxidized multifunctional bisphenol B novolak resin, crosslinking density of a prepolymer may deteriorate.

The first and second negative photoresist compositions may include other additives, such as a photoaccelerator, a filler, a viscosity modifier, a wetting agent, and an optical stabilizer. The amount of each additive may be in a range of about 0.1 to 20 parts by weight based on 100 parts by weight of the epoxidized multifunctional bisphenol B novolak resin.

The photoaccelerator absorbs light energy and enables easy energy transmission to other compounds, and accordingly, a radical or ion initiator may be formed. An accelerator frequently enlarges an energy wavelength range useful in exposure and is typically an aromatic light absorbing chromophore. Also, the accelerator may induce formation of a radical or ion optical initiator.

Regarding substituents, an alkyl group may be a C1-C20 linear or branched alkyl group, a C1-C12 linear or branched alkyl group, or a C1-C6 linear or branched alkyl group. Examples of such an unsubstituted alkyl group include methyl, ethyl, n-propyl, isopropyl, n-butyl, isobutyl, sec-butyl, t-butyl, penthyl, isoamyl, and hexyl. At least one hydrogen atom included in the alkyl group may be substituted with a halogen atom, a hydroxy group, —SH, a nitro group,

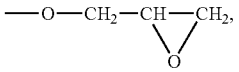

a cyano group, a substituted or unsubstituted amino group (—$NH_2$, —NH(R), —N(R')(R"), wherein R' and R" may be each independently a C1-C10 alkyl group), an amidino group, a hydrazine or hydrazone group, a carboxyl group, a sulfonic acid group, a phosphoric acid group, a C1-C20 alkyl group, a C1-C20 halogenated alkyl group, a C1-C20 alkenyl group, a C1-C20 alkynyl group, a C1-C20 heteroalkyl group, a C6-C20 aryl group, a C6-C20 arylalkyl group, a C6-C20 heteroaryl group, or a C6-C20 heteroarylalkyl group.

A cycloalkyl group denotes, for example, a C3-C20, C3-C10, or C3-C6 monovalent monocyclic system. At least one hydrogen atom of the cycloalkyl group may be substituted with substituents of the alkyl group.

A heterocycloalkyl group includes 1, 2, or 3 hetero atoms selected from among N, O, P, and S, and denotes a monovalent monocyclic system having 3-20, 3-10, or 3-6 ring atoms, wherein the rest of the ring atoms are carbon. At least one hydrogen atom of the heterocycloalkyl group may be substituted with substituents of the alkyl group.

An alkoxy group may be, for example, an oxygen-containing linear or branched alkoxy group each having a C1-C20 alkyl portion, an alkoxy group having 1-6 carbon atoms, or an alkoxy group having 1-3 carbon atoms. Examples of the alkoxy group include methoxy, ethoxy, propoxy, butoxy, and t-butoxy. The alkoxy group may provide a haloalkoxy group by further being substituted with at least one halo atom, such as fluoro, chloro, or bromo. Examples of the haloalkoxy group include fluoromethoxy, chloromethoxy, trifluoromethoxy, trifluoroethoxy, fluoroethoxy, and fluoropropoxy. At least one hydrogen atom of the alkoxy group may be substituted with substituents of the alkyl group.

An alkenyl group denotes a C2-C20 linear or branched aliphatic hydrocarbon group having a carbon-carbon double bond. For example, the alkenyl group has 2-12 carbon atoms in a chain, or 2-6 carbon atoms in a chain. The brandied aliphatic hydrocarbon group means at least one lower alkyl or lower alkenyl group attached to an alkenyl straight chain. Such an alkenyl group may not be substituted or independently substituted with at least one group including, but not limited thereto, halo, carboxy, hydroxyl, formyl, sulfo, sulfino, carbamoyl, amino, and imino. Examples of such an alkenyl group include ethenyl, prophenyl, carboxyethenyl, carboxyprophenyl, sulfinoethenyl, and sulfonoethenyl. At least one hydrogen atom of the alkenyl group may be substituted with a substituent of the alkyl group.

An alkynyl group denotes a C2-C20 linear or branched aliphatic hydrocarbon group having a carbon-carbon triple bond. For example, the alkynyl group has 2-12 carbon atoms in a chain, or 2-6 carbon atoms in a chain. The branched aliphatic hydrocarbon group means at least one lower alkyl or lower alkynyl group is attached to an alkynyl straight chain. Such an alkynyl group may not be substituted or independently substituted with at least one group including, but not limited to, halo, carboxy, hydroxy, formyl, sulfo, sulfino, carbamoyl, amino, and imino. At least one hydrogen atom of the alkynyl group may be substituted with a substituent of the alkyl group.

A heteroalkyl group for example, denotes the alkyl group in which a C1-C20, C1-C12, or C1-C6 main chain includes a hetero atom, such as N, O, P, or S. At least one hydrogen atom of the heteroalkyl group may be substituted with a substituent of the alkyl group.

An aryl group denotes a C6-C30 carbocycle aromatic system including at least one ring that is used independently or in combination, wherein the at least one ring is attached or fused together via a pendant method. The aryl group includes an aromatic radical, such as phenyl, naphthyl, tetrahydronaphthyl, indan, and biphenyl. At least one hydrogen atom of the aryl group may be substituted with a substituent of the alkyl group.

An arylalkyl group denotes at least one hydrogen atom of the alkyl group substituted with the aryl group.

A heteroaryl group includes 1, 2, or 3 hetero atoms selected from among N, O, P, and S, and denotes a monovalent monocyclic or bicyclic aromatic radical having 5-30 ring atoms, wherein the rest of the ring atoms are carbon. The heteroaryl group also denotes a monovalent monocyclic or bicyclic aromatic radical, in which a hetero atom in a ring is oxidized to form, for example, an N-oxide or a quaternary salt. Examples of the heteroaryl group include thienyl, benzothienyl, pyridyl, pyrazinyl, pyrimidinyl, pyridazinyl, quinolinyl, quinoxalinyl, imidazolyl, furanyl, benzofuranyl, thiazolyl, isoxazoline, benzisoxazoline, benzimidazolyl, triazolyl, pyrazolyl, pyrrolyl, indolyl, 2-pyridonyl, N-alkyl-2-pyridonyl, pyrazinonyl, pyridazinonyl, pyrimidinonyl, oxazolonyl, an N-oxide corresponding thereto, such as pyridyl N-oxide and quinolinyl N-oxide, and quaternary salt thereof, but are not limited thereto. At least one hydrogen atom of the heteroaryl group may be substituted with a substituent of the alkyl group.

A heteroarylalkyl group denotes at least one hydrogen atom of the alkyl group substituted with the heteroaryl group, and a C3-C30 carbocycle aromatic system. At least one hydrogen atom of the heteroarylalkyl group may be substituted with a substituent of the alkyl group.

A method of manufacturing the thermal inkjet printhead will now be described. FIGS. 3 through 13 are cross-sectional views for describing a method of manufacturing an inkjet printhead, according to an embodiment of the disclosure.

Figure 3:
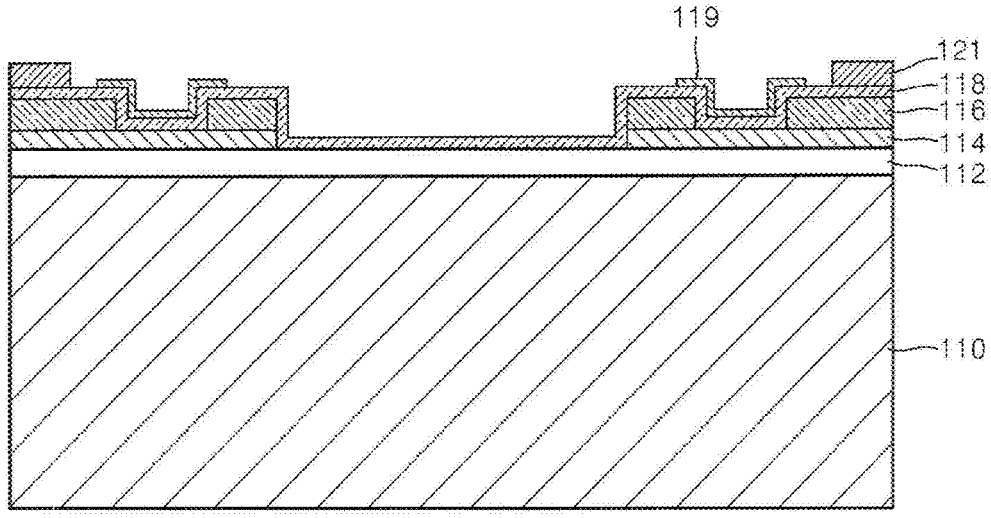
FIGS. 3 through 13 are cross-sectional views for describing a method of manufacturing an inkjet printhead. In particular, those figures show the following.

Referring to FIG. 3, a substrate 110 is prepared. An insulation layer 112 may be formed on the top surface of the substrate 110. As shown in FIG. 3, the insulation layer 112 may be in direct contact with substrate 110. The substrate 110 may be formed of silicon. The insulation layer 112 may be disposed between the substrate 110 at least one heater 114. The insulation layer may be formed of a silicon oxide. Then, the heaters 114, for forming bubbles by heating ink, is formed on the top surface of the insulation layer 112. The heaters may be in contact with the insulation layer 112. The heaters 114 may be formed by depositing a resistance-heating material, such as tantalum-aluminium alloy, tantalum nitride, titanium nitride, or tungsten silicide, on the top surface of the insulation layer 112, and then patterning the resistance-heating material. Then, a plurality of electrodes 116 for applying a current to the heaters 114 are formed on the top surface of the heaters 114. The electrodes 116 may be formed by depositing a metal having excellent electrical conductivity, such as aluminium, aluminium alloy, gold, or silver, on the top surface of the heaters 114 and then patterning the metal.

A passivation layer 118 may be formed on the insulation layer 112. This layer 118 may cover the heaters 114 and the electrodes 116. The passivation layer 118 prevents the heaters 114 and the electrodes 116 from being oxidized or corroded by contacting the ink. This layer 118 may be formed of a silicon nitride or a silicon oxide. Layer 118 may be in contact with electrodes 116 and heater 114.

A glue layer 121 may be selectively formed on the passivation layer 118. The glue layer 121 increases adhesive strength between a chamber material layer (120' in FIG. 4) and the passivation layer 118. The glue layer 121 may be in contact with passivation layer 118.

An anti-cavitation layer 119 may be formed on the top surface of the passivation layer 118, which may be disposed on the top surface of the heaters 114. The anti-cavitation layer 119 protects the heaters 114 from a cavitation force generated when the bubbles disappear. The layer 119 may be formed of tantalum.

Figure 4:
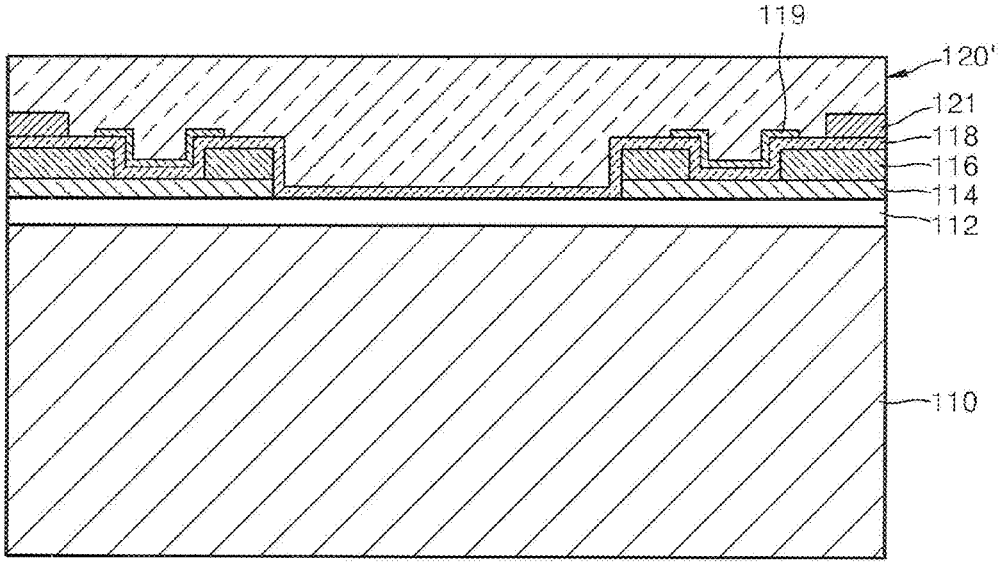

The chamber layer 120 (FIG. 2) may then be formed above the substrate 110. Referring to FIG. 4, a chamber material layer 120' is formed on the passivation layer 118. Chamber material layer 120' may be in contact with glue layer 121, anti-cavitation layer 119 and passivation layer 118. The chamber material layer 120' includes a first negative photoresist composition. The chamber material layer 120' may be formed by laminating a dry film including a photosensitive resin and a photo acid generator (PAG) on the passivation layer 118. The photosensitive resin included in the chamber material layer 120' may be a negative type photosensitive polymer. The photosensitive resin may be an alkali soluble resin. Examples of the alkali soluble resin include ANR manufactured by AZ, SPA manufactured by Shinetsu, and WPR manufactured by JSR, but are not limited thereto.

An exposure process is performed on the chamber material layer 120'. In detail, the exposure process is performed on the chamber material layer 120' by using a photomask (not shown) on which an ink chamber pattern and a restrictor pattern are formed. When the chamber material layer 120' includes the first negative photoresist composition, ions or free radicals initiating polymerization by using a cationic optical initiator, are generated in an exposure portion 120'*a* of the chamber material layer 120' via the exposure process. Also, if the chamber material layer 120' includes a negative type photosensitive polymer, an acid is generated by using a photo acid generator (PAG), in the exposure portion 120'*a* of the chamber material layer 120'.

Then, a PEB process is performed on the exposed chamber material layer 120'. The PEB process may be performed for about 3 to about 5 minutes at about 90 to about 120° C. Then, the first negative photoresist composition is cross-linked on the exposure portion 120' a via the PEB process and, thus, a cross linked product is formed.

Figure 5:
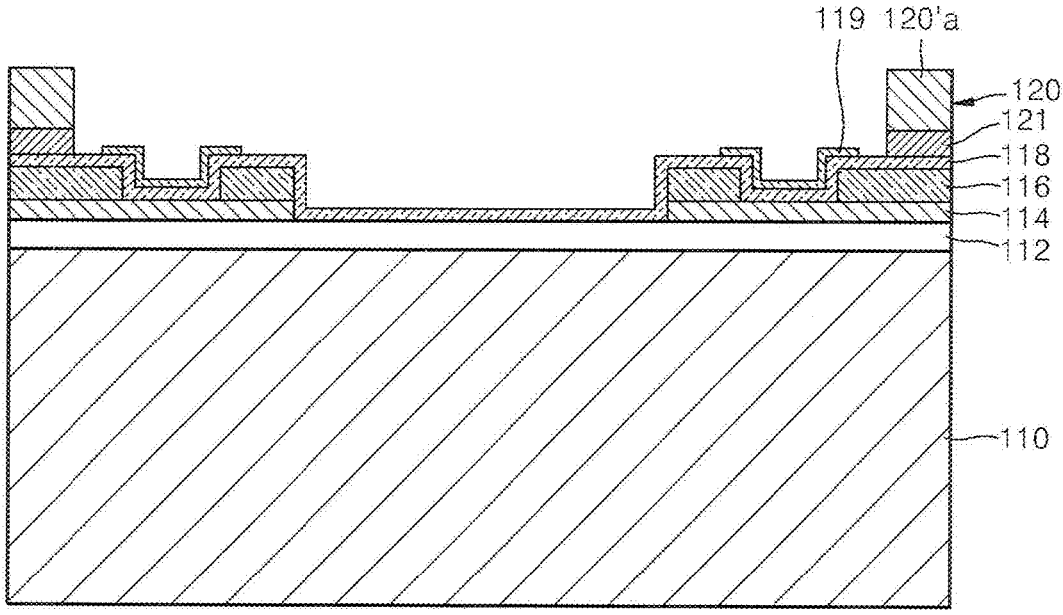

Referring to FIG. 5, a developing process is performed on the chamber material layer 120', on which the exposure process and the FEB process are performed, so as to form the chamber layer 120. A non-exposure portion (not shown) of the chamber material layer 120' is removed by using a predetermined developer during the developing process. Since the first negative photoresist composition included in the exposure portion 120'*a* of the chamber material layer 120' has a cross-linked structure due to the PEB process, the exposure portion 120'*a* of the chamber material layer 120' is not removed during the developing process and forms the chamber layer 120.

Figure 6:
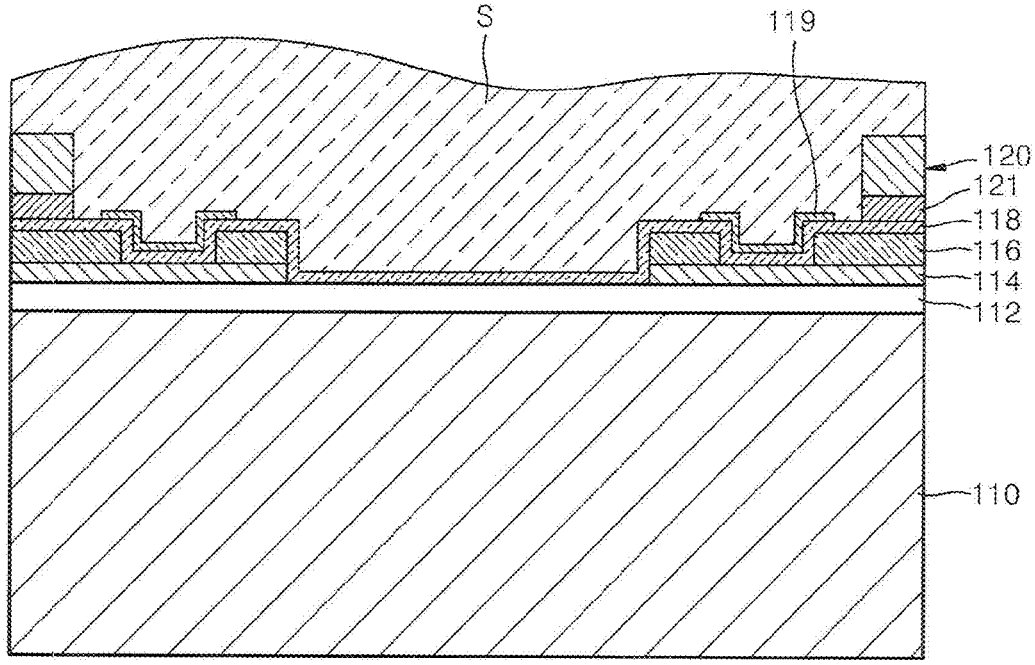

Referring to FIG. 6, a sacrificial layer S is formed on the chamber layer 120, on which the exposure process and the PEB process have been performed. The sacrificial layer S is formed to cover the top surface of the chamber layer 120. Sacrificial layer S may also be in contact with anti-cavitation layer 119, passivation layer 118 and glue layer 121. The sacrificial layer S may be formed by coating a positive photoresist or a non-photosensitive soluble polymer on the substrate 110 to a predetermined thickness using a spin coating method. The positive photoresist may be, for example, an imide-based positive photoresist. If an imide-based positive photoresist is used to form the sacrificial layer S, the sacrificial layer S is not significantly affected by the solvent, and does not generate nitrogen gas even when exposed to light. Accordingly, the imide-based positive photoresist may be hard baked at a temperature of about 140° C. The sacrificial layer S may be formed by coating a liquefied non-photosensitive soluble polymer on the substrate 110 to a predetermined thickness using a spin coating method and then baking the liquefied non-photosensitive soluble polymer. The liquefied non-photosensitive soluble polymer may include at least one of the group consisting of a phenol resin, a polyurethane resin, an epoxy resin, a polyimide resin, an acrylic resin, a polyamide resin, an urea resin, a melamine resin, and a silicon resin.

Figure 7:
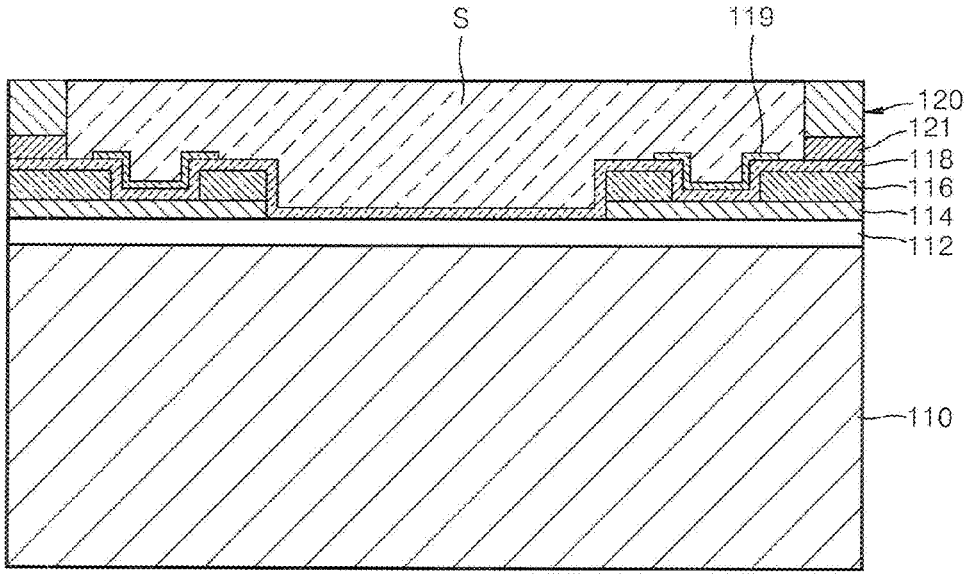

Then, as illustrated in FIG. 7, the top surfaces of the chamber layer 120 and the sacrificial layer S are planarized using a chemical mechanical polishing (CMP) process. In detail, when upper portions of the sacrificial layer S and the chamber layer 120 are polished to a desired height of an ink path using the CMP process, the top surfaces of the chamber layer 120 and the sacrificial layer S have substantially the same height.

Figure 8:
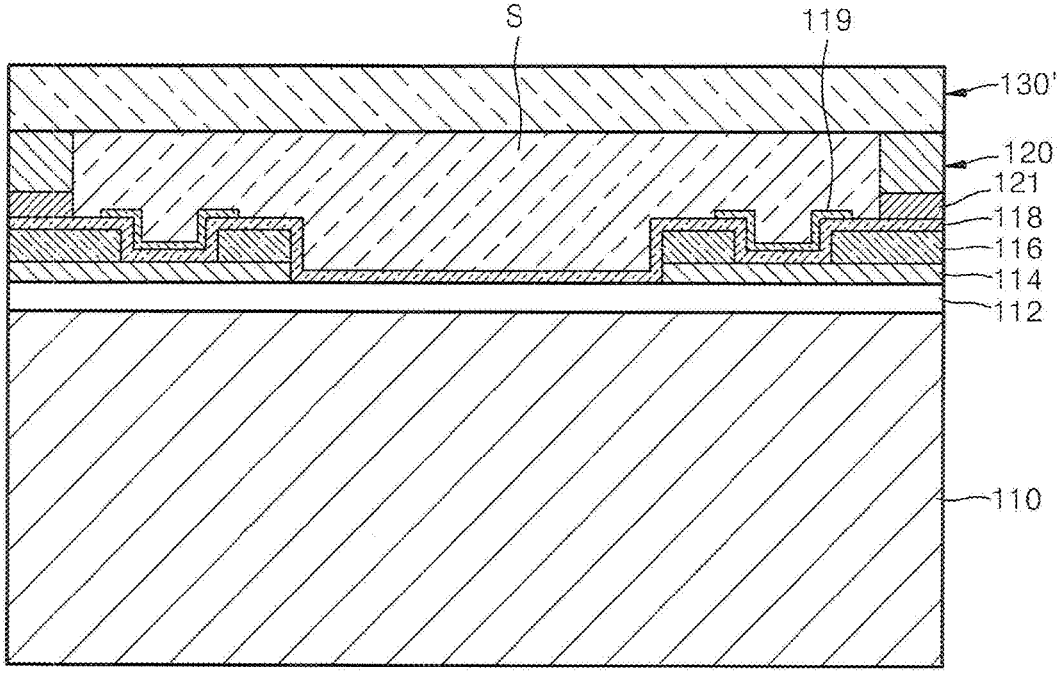

Then, referring to FIG. 8, a nozzle material layer 130' is formed on the chamber layer 120 and the sacrificial layer S. The nozzle material layer 130' includes a second negative photoresist composition. The nozzle material layer 130' may be formed by laminating a dry film including a photosensitive resin and PAG on the chamber layer 120. The photosensitive resin included in the nozzle material layer 130' may be a negative type photosensitive polymer.

Figure 9:
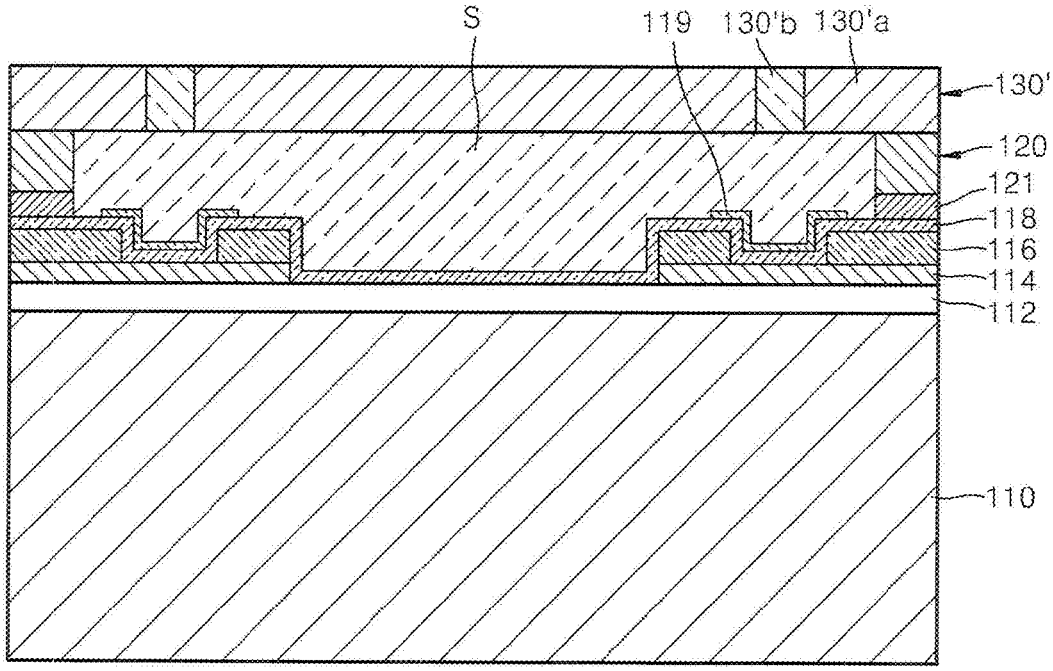

Processes of forming a nozzle layer 130 and a plurality of nozzles 132 will now be described with reference to FIGS. 9 and 10. First, an exposure process is performed on the nozzle material layer 130'. The exposure process may be performed on the nozzle material layer 130' by using a photomask (not shown), on which a nozzle pattern is formed. The nozzle material layer 130' includes the second negative photoresist composition, ions or free radicals, which initiate polymerization by using a cationic optical initiator, are generated in an exposure portion 130'*a* of the nozzle material layer 130' via the exposure process. Also, when the nozzle material layer 130' includes a negative type photosensitive polymer, an acid is generated by using a PAG in the exposure portion 130'*a* of the nozzle material layer 130' via the exposure process. In FIG. 9, a reference numeral 130'*b* denotes a non-exposure portion of the nozzle material layer 130'.

Figure 10:
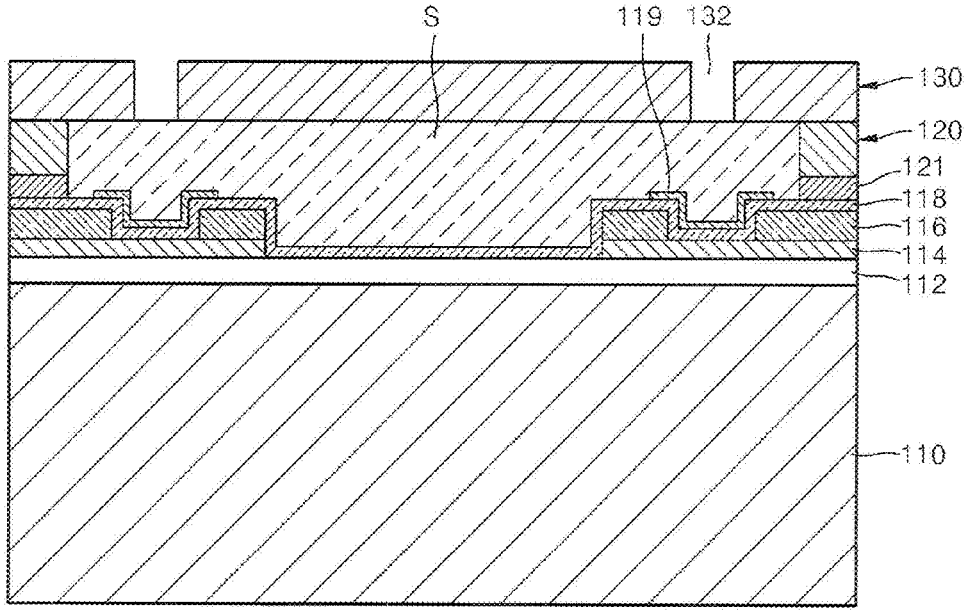

Referring to FIG. 10, the nozzle layer 130 is then formed by performing a PEB process and a developing process on the nozzle material layer 130', on which the exposure process is performed. The PEB process is performed on the nozzle material layer 130'. The PEB process may be performed, for example, at a temperature of about 90 to about 120° C., for about 3 to about 5 minutes, but the conditions under which the PEB process is performed are not limited thereto. As a result of the PEB process, the second negative photoresist composition is cross-linked in the exposure portion 130'*a* of the nozzle material layer 130'.

Then, the nozzle material layer 130', on which the PEB process is performed, is developed. By performing such a developing process, the non-exposure portions 130'*b* of the nozzle material layer 130' are removed by using a predetermined developer and, thus, a plurality of nozzles 132 are formed. Here, since the second negative photoresist composition included in the exposure portion 130'*a* of the nozzle material layer 130' has a cross-linked structure via the PEB process, the exposure portion 130'*a* of the nozzle material layer 130' is not removed during the developing process, and forms the nozzle layer 130.

Figure 11:
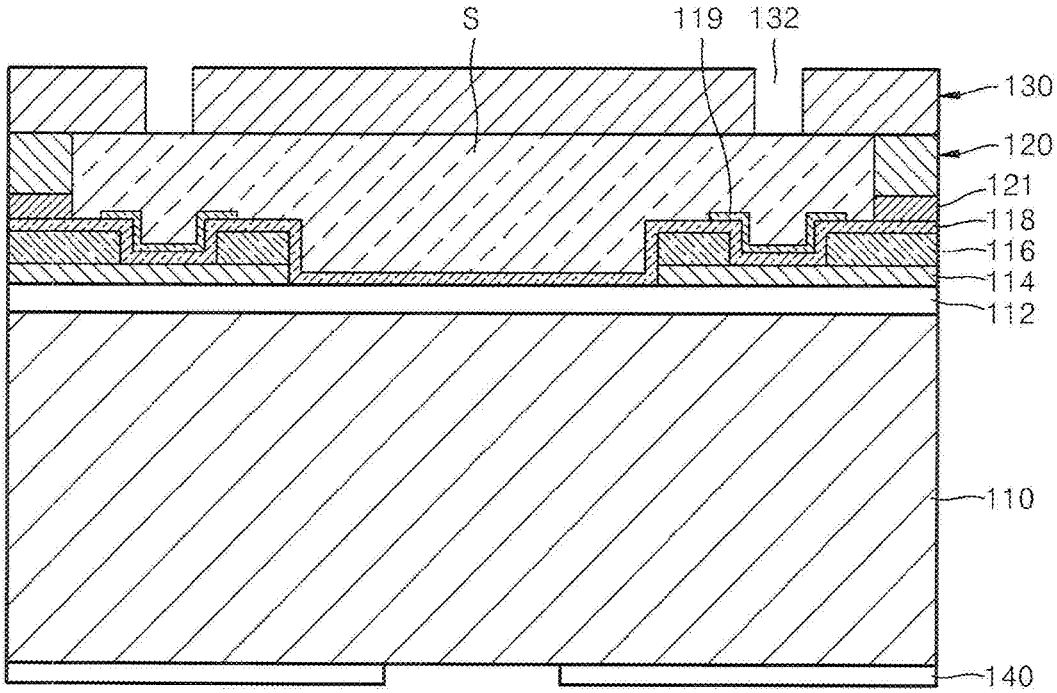

As illustrated in FIG. 11, an etching mask 140 for forming an ink feed hole 111 (illustrated in FIG. 12) is then formed on a rear or bottom surface of the substrate 110. The etching mask 140 may be formed by coating a positive or negative photoresist on the rear or bottom surface of the substrate 110 and then patterning the positive or negative photoresist.

Figure 12:
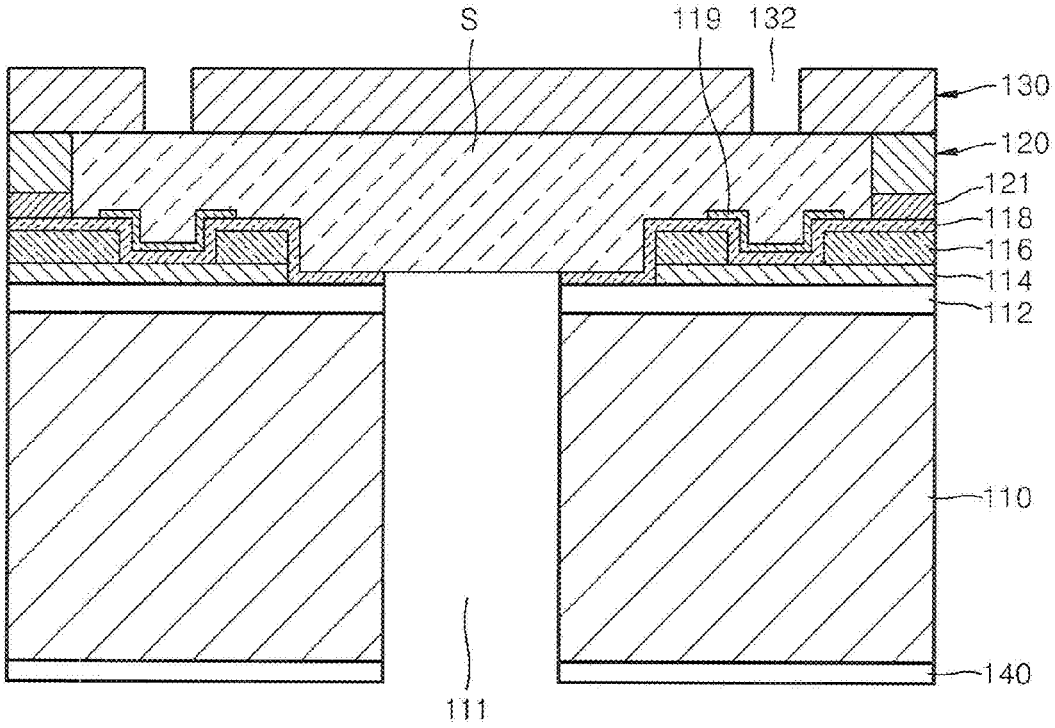

Then, as illustrated in FIG. 12, the ink feed hole 111 is formed by etching the substrate 110 from the rear or bottom surface of the substrate 110 exposed by the etching mask 140 so as to penetrate the substrate 110. Then, the etching mask 140 is removed. The etching of the substrate 110 may be performed using a dry etching method using plasma. Alternatively, the etching of the rear surface of the substrate 110 may be performed using a wet etching method using tetramethyl ammonium hydroxide (TMAH) or KOH as an etchant. Alternatively, the etching of the rear surface of the substrate 110 may be performed using a laser process, or other various methods.

Figure 13:
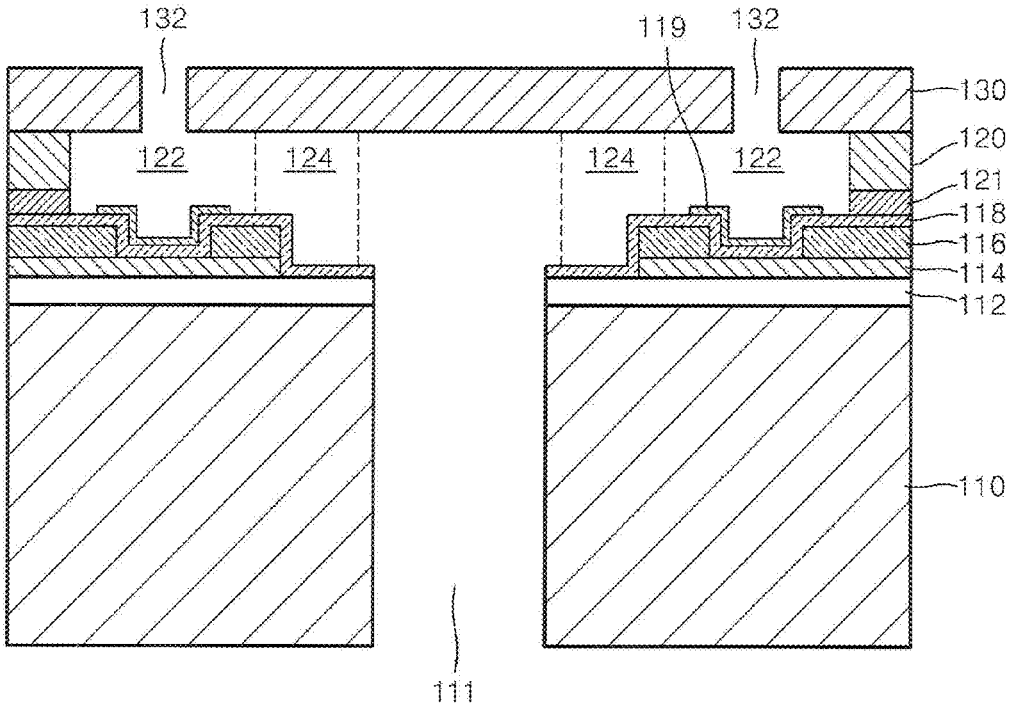

When the sacrificial layer S is removed by the solvent, a plurality of ink chambers 122 and a plurality of restrictors 124 surrounded by the chamber layer 120 are formed as illustrated in FIG. 13.

Thus, an inkjet printhead is manufactured using the method of manufacturing an inkjet printhead according to the disclosure.

An inkjet printhead will now be described with reference to the following examples. However, these examples are for illustrative purposes only and are not intended to limit the scope.

SYNTHESIS EXAMPLE 1

Preparation of Epoxidized Multifunctional Bisphenol B Novolak Resin (1) Preparation of Bisphenol B Novolak Resin 100 g of bisphenol B, 8 g of 89% formalin, and 0.035 g of diethylsulfur were put into a 2 L flask, and the contents were heated to a temperature of 90° C. under a nitrogen blanket. When the contents were completely dissolved, the temperature was increased to 120° C., and then the contents were additionally heated for 3 hours. Then, the reactant was vacuum-distilled at a temperature of 165 to 176° C. under a 16.5 to 30 inch mercury vacuum so as to obtain 97 g of a flaking product and 11 g of distilled water.

(2) Epoxidization of Novolak Resin

A reaction mixture was obtained by filling a 1 L flask with 30 g of the flaking product obtained in (1), 5.2 g of potassium hydroxide, 15 g of epichlorohydrin, and 40 g of reaction solvent methylisobutylketone. The reaction mixture was reacted for 1 hour by increasing the temperature to 60° C., and then 40 g of an aqueous 20% sodium hydroxide solution was injected to the reaction mixture 3 times for 3 hours while maintaining the temperature at 60±5° C. Then, the temperature was increased to 150° C. so as to discharge condensation water. Next, 45 g of water and 30 g of methylisobutylketone were added to the reaction mixture, the resultant was maintained at 80° C. for 1 hour, and then was moved to a separate funnel. A lower salt layer was removed, and an upper organic layer was cleaned 2 times, and then neutralized with a phosphoric acid. Then, the upper organic layer was filtered, vacuum-distilled so as to remove excessive epichlorohydrin, methylisobutylketone, and water. Accordingly, about 27 g of an epoxidized multifunctional bisphenol B novolak resin having a dark color was obtained. Epoxidized weight average molecular weight of the epoxidized multifunctional bisphenol B novolak resin was 3684, a softening point was 64.5° C., and an epoxy equivalent was 199 (g/eq.).

PREPARATION EXAMPLE 1

Preparation of Negative Photoresist Composition 60 g of epoxidized multifunctional bisphenol B novolak resin obtained in Synthesis Example 1, 35 g of cyclopentane (CP), and 5 g of SP-172 manufactured by Asahi Denka Korea Chemical Co. were put into a jar so as to obtain a resist solution. Then, the solution was mixed for about 24 hours by using an impeller and then filtered by using a 5 mm filter so as to obtain a negative photoresist composition.

EXAMPLE 1

An insulation layer (112 of FIG. 3) formed of a silicon oxide to a thickness of about 2 μm, a pattern of a heater (114 of FIG. 3) formed of tantalum nitride to a thickness of about 500 Å, a pattern of an electrode (116 of FIG. 3) formed of AlSiCu alloy (each of Si and Cu having 1 wt % or lower) to a thickness of about 500 Å, a passivation layer (118 of FIG. 3) formed of silicon nitride to a thickness of about 3000 Å, and an anti-cavitation layer (119 of FIG. 3) formed of tantalum to a thickness of about 3000 Å were formed on a 6 inch silicon water (substrate 110 of FIG. 3) using a conventional sputtering process and a photolithography process.

Then, the silicon wafer on which the plurality of layers were formed was left at 200° C. for 10 minutes so as to remove moisture, and then a HMDS process was performed so as to promote adhesion. Next, SU-8 (MicroChem Corporation) having low viscosity, which is a photosensitive resin composition for forming a glue layer, was spin-coated on the silicon wafer at a rate of 2000 rpm/40 sec. and then soft-baked for 3 minutes at 95° C. Then, the silicon wafer was exposed to ultraviolet rays having light intensity of 13 mW/cm$^2$ for 5 seconds by using a negative photomask and then post exposure baked for 1 minute at 95° C. so as to form a pattern. Next, the silicon wafer was developed for 30 seconds by using PGMEA as a developer, rinsed by using IPA, and then dried. Then, the silicon wafer was post baked for 5 minutes at 90° C. and 10 minutes at 180° C., and slowly cooled to form a glue layer (121 of FIG. 3) on the passivation layer, having a thickness of 2 micron.

The negative photoresist composition prepared in Preparation Example 1 was spin-coated for 40 seconds at a rate of 2000 rpm on the silicon wafer, and then the silicon wafer was baked for 7 minutes at 95° C. so as to form a first negative photoresist layer, i.e. a chamber material layer (120' of FIG. 4), having a thickness of about 10 μm. Then, as illustrated in FIG. 5, the first negative photoresist layer was exposed to i-line ultraviolet rays (UV) by using a first photomask on which predetermined ink chamber and restrictor patterns were formed. Here, the intensity of the i-line UV rays was adjusted to 130 mJ/cm$^2$. Next, the silicon wafer was baked for 3 minutes at 95° C., developed by dipping the silicon wafer for 1 minute in PGMEA, and rinsed for 20 seconds by using isopropanol. Accordingly, a chamber layer (120 of FIG. 6) was formed.

As illustrated in FIG. 7, an imide-based positive photoresist (product name: PW-1270, manufactured by Toray) was spin-coated on the entire surface of the silicon wafer on which the chamber layer was formed, for 40 seconds at a rate of 1000 rpm. Then, the silicon wafer was baked for 10 minutes at about 140° C. so as to form a sacrificial layer. An overcoated thickness of the sacrificial layer was adjusted to be about 5 μm on the chamber layer.

As illustrated in FIG. 8, top surfaces of the chamber layer and the sacrificial layer were planarized by using a chemical mechanical polishing process. For this, the silicon wafer was disposed on a polishing pad (product no.: JSR FP 8000, manufactured by JSR) of a polishing plate in such a way that the sacrificial layer faced the polishing pad. Then, the silicon wafer was pressurized by applying a baking pad to the polishing pad by using a press head at a pressure in a range of about 10 to about 15 kPa. The press head was rotated with respect to the polishing pad while supplying a polishing slurry (POLIPLA 103 manufactured by FUJIMI Corporation). Here, the press head and the polishing pad were each rotated at a rate of 40 rpm. The baking pad was formed of a material having a shore D hardness in a range of about 30 to about 70. The top surface of the chamber layer was planarized by removing the sacrificial layer until about 1 μm of the top surface of the chamber layer was removed while adjusting an etching rate to about 5 to about 7 μm/min.

As illustrated in FIGS. 8, 9, and 10, a nozzle layer was formed in the same manner as the chamber layer by using the negative photoresist composition prepared in Preparation Example 1 and a photomask, on the silicon wafer on which the chamber layer and the sacrificial layer were formed.

Then, as illustrated in FIG. 11, an etching mask for forming an ink feed hole was formed using a conventional photolithography method on the rear surface of the silicon wafer. The silicon wafer was plasma-etched from the rear surface of the silicon wafer that was exposed by the etching mask so as to form the ink feed hole, and then the etching mask was removed. Here, the power of a plasma-etching apparatus used to perform the plasma etching was 2000 W, an etching gas was a mixed gas of $SF_6$ and $O_2$, wherein a mixed volume ratio of the $SF_6$ and $O_2$ was 10:1, and an etching rate was 3.7 μm/min.

The silicon wafer was dipped in a methyl loctate solvent for 2 hours so as to remove the sacrificial layer, thereby forming ink chambers and restrictors surrounded by the chamber layer in a space from which the sacrificial layer was removed as illustrated in FIG. 13. Accordingly, the manufacture of an inkjet printhead having the structure illustrated in FIG. 13 was completed.

Pattern Evaluation

The negative photoresist composition prepared in Preparation Example 1 was spin-coated on a 6 inch silicon wafer for 40 seconds at 300 rpm, and heated for 7 minutes at 95° C. so as to form a layer having a uniform thickness of 10 μm.

Figure 14A:
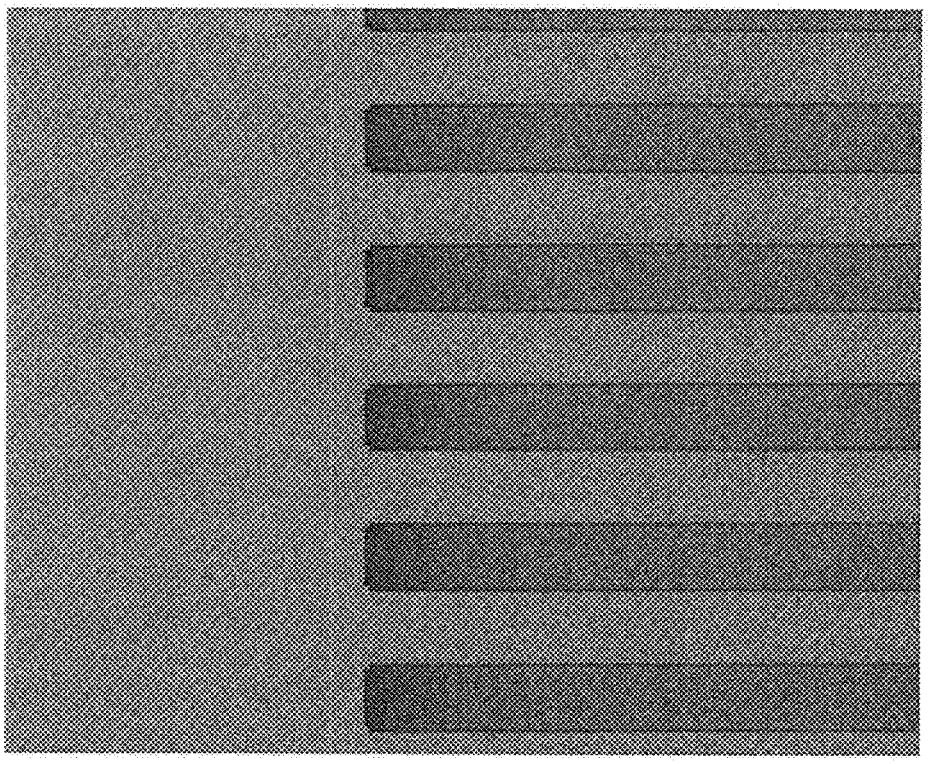
FIGS. 14A and 14B are scanning electron microscope (SEM) images of a pattern formed by using a negative photoresist composition obtained according to Preparation Example 1.
Figure 14B:
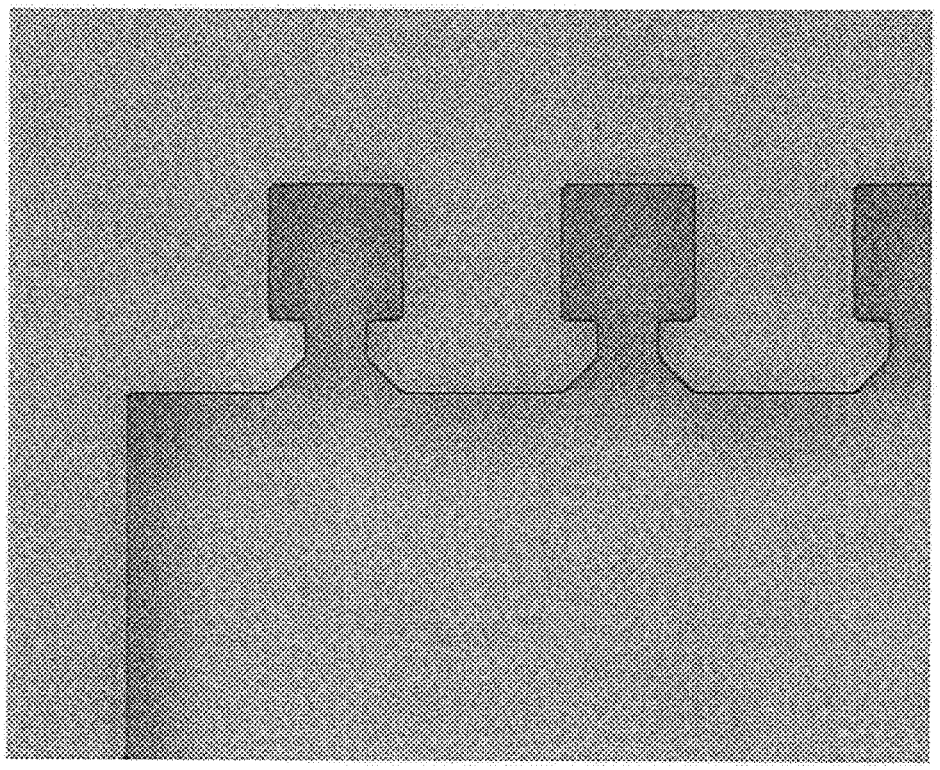

Then, the silicon wafer was exposed to 260 mJ/cm$^2$ I-line light by using a Hg/Xe lamp exposure device, heated for 3 minutes at 95° C., developed for 1 minute by using PGMEA, and then rinsed for 10 seconds by using isopropyl alcohol so as to form a pattern A. FIGS. 14A and 14B are scanning electron microscope (SEM) images of the pattern A.

Figure 15A:
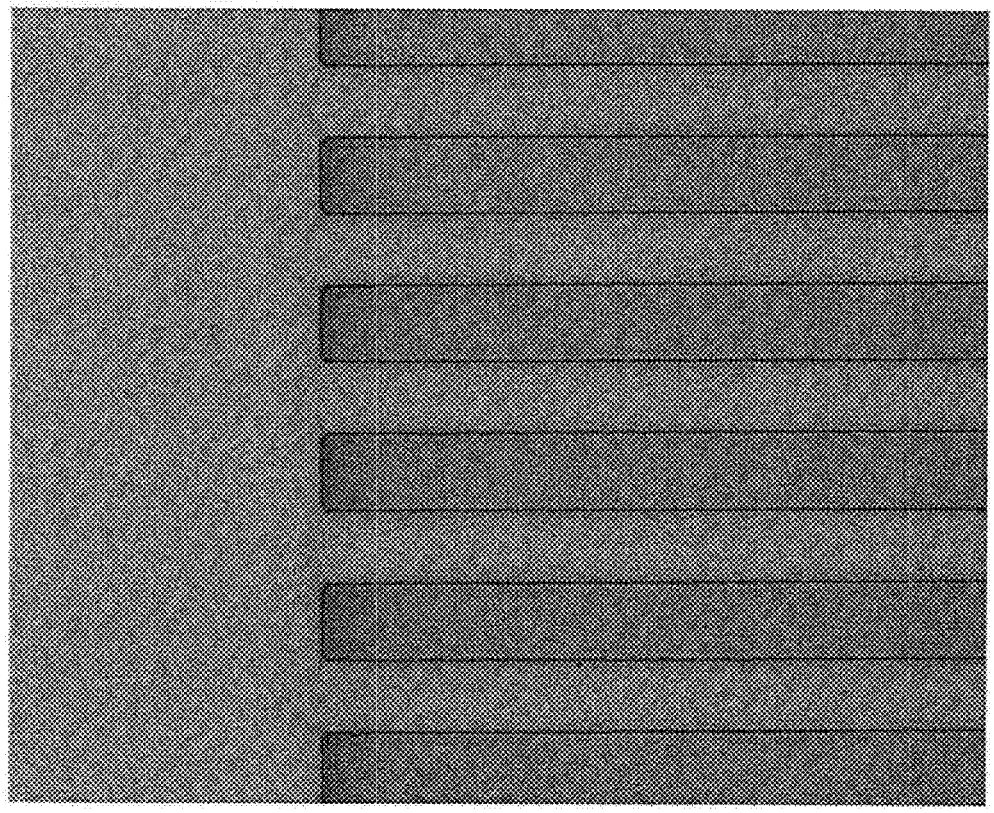
FIGS. 15A and 15B are SEM images of a pattern formed by using a negative photoresist composition obtained in the same manner as Preparation Example 1, except that SU-8 (MicroChem Corporation), which is a bisphenol A epoxy resin, is used instead of an epoxidized multifunctional bisphenol B novolak resin obtained in Synthesis Example 1.
Figure 15B:
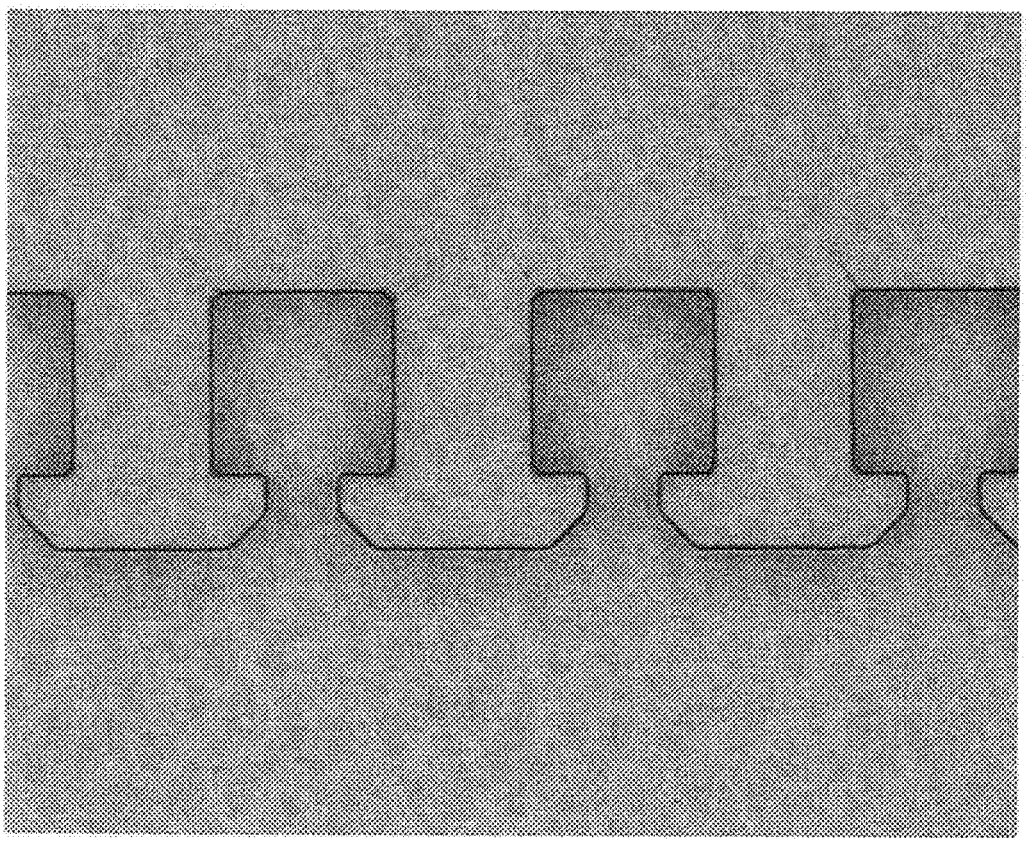

Meanwhile, a negative photoresist composition was prepared in the same manner as Preparation Example 1, except that SU-8 (manufactured by MicroChem Corporation), which is a bisphenol A epoxy resin, was used instead of the epoxidized multifunctional bisphenol B novolak resin prepared in Synthesis Example 1, and a pattern B was formed in the same manner as the forming of the pattern A. FIGS. 15A and 1513 are SEM images of the pattern B.

Referring to FIGS. 14A, 14B, 15A, and 15B, the pattern A using the epoxidized multifunctional bisphenol B novolak resin is stable in that cracks are not generated after development, unlike the pattern B using the bisphenol A epoxy resin. This is because, as described above, the epoxidized multifunctional bisphenol B novolak resin has an amorphous characteristic due to having an asymmetrical molecular structure and thus has improved flexibility and coating properties compared to the bisphenol A novolak resin.

An inkjet printhead having excellent mechanical characteristics and excellent adhesive properties with a substrate, and including a chamber layer and a nozzle layer that do not crack due to improved flexibility, can be manufactured using a simple process.

While the disclosure has been particularly shown and described with reference to representative examples thereof, it will be understood by those of ordinary skill in the art that various changes in form and details may be made therein without departing from the spirit and scope of the disclosure as defined by the following claims.

What is claimed is:

1. An inkjet printhead comprising:

a substrate having at least one ink feed passage;

a chamber layer disposed above the substrate, the chamber layer comprised of a cured product of a first negative photoresist composition, the chamber layer having at least one ink chamber in communication with the ink feed passage; and a nozzle layer disposed above the chamber layer, the nozzle layer comprised of a cured product of a second negative photoresist composition, the nozzle layer having at least one nozzle in communication with the ink chamber, the nozzle configured to eject ink, wherein the first negative photoresist composition and the second negative photoresist composition comprise an epoxidized multifunctional bisphenol B novolak resin, a cationic optical initiator, and a solvent.

2. The inkjet printhead of claim 1, wherein the epoxidized multifunctional bisphenol B novolak resin is represented by Formula 1 below:

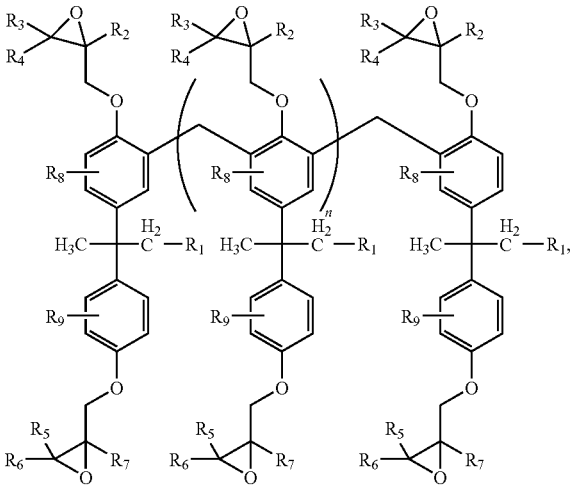

wherein n is an integer in a range of 1 to 20, wherein $R_1$ is a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group, and wherein $R_2$ through $R_9$ are each independently a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

3. The inkjet printhead of claim 1, wherein the epoxidized multifunctional bisphenol B novolak resin is represented by Formula 2 below:

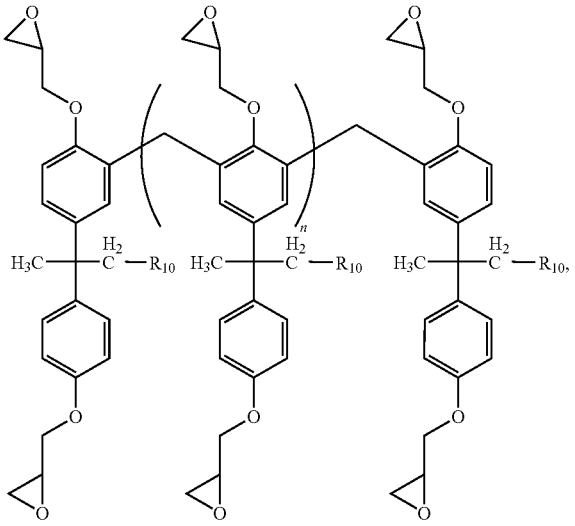

wherein n is an integer in a range of 1 to 20, and wherein $R_{10}$ is a halogen atom, a hydroxy group, a substituted or unsubstituted $C_1$-$C_{20}$ alkyl group, a substituted or unsubstituted carboxyl group, or a substituted or unsubstituted $C_1$-$C_{20}$ alkylsiloxane group.

4. The inkjet printhead of claim 1, wherein the epoxidized multifunctional bisphenol B novolak resin is a product of a reaction of a bisphenol B novolak resin and epichlorohydrin.

5. The inkjet printhead of claim 1, wherein the cationic optical initiator comprises an aromatic halonium salt or an aromatic sulfonium salt.

6. The inkjet printhead of claim 1, wherein the solvent comprises at least one selected from the group consisting of alpha-butyrolactone, gamma-butyrolactone, propylene glycol methyl ethyl acetate, tetrahydrofuran, methyl ethyl ketone, methyl isobutyl ketone, cyclopentanon, and xylene.

7. The inkjet printhead of claim 1, wherein the first negative photoresist composition and the second negative photoresist composition each comprises about 1 to about 10 parts by weight of the cationic optical initiator and about 30 to about 300 parts by weight of the solvent based on 100 parts by weight of the epoxidized multifunctional bisphenol B novolak resin.

8. The inkjet printhead of claim 1, further comprising:

at least one insulation layer formed above the substrate;

at least one heater and at least one electrode sequentially formed above the insulation layer; and at least one passivation layer substantially covering the heater and electrode.

9. The inkjet printhead of claim 8, further comprising at least one anti-cavitation layer on the passivation layer.

10. The inkjet printhead of claim 1, further comprising at least one glue layer between the substrate and the chamber layer.

11. A method of manufacturing an inkjet printhead, the method comprising:

forming a chamber layer on a substrate by curing a first negative photoresist composition comprising an epoxidized multifunctional bisphenol B novolak resin, a cationic optical initiator, and a solvent;

forming a nozzle layer by curing a second negative photoresist composition comprising an epoxidized multifunctional bisphenol B novolak resin, a cationic optical initiator, and a solvent, the nozzle layer comprising a plurality of nozzles;

forming an ink feed passage in a rear surface of the substrate; and forming an ink chamber and a restrictor in communication with the ink feed passage.

12. The method of claim 11, wherein the epoxidized multifunctional bisphenol B novolak resin is represented by Formula 1 below:

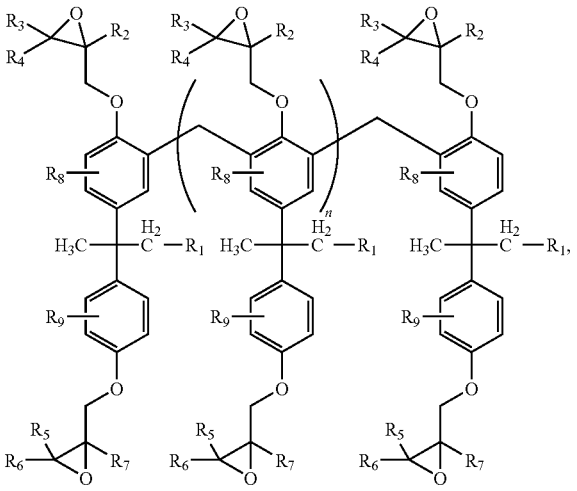

wherein n is an integer in a range of 1 to 20, wherein $R_1$ is a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group, and wherein $R_1$ through $R_9$ are each independently a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

13. The method of claim 11, wherein the epoxidized multifunctional bisphenol B novolak resin is represented by Formula 2 below:

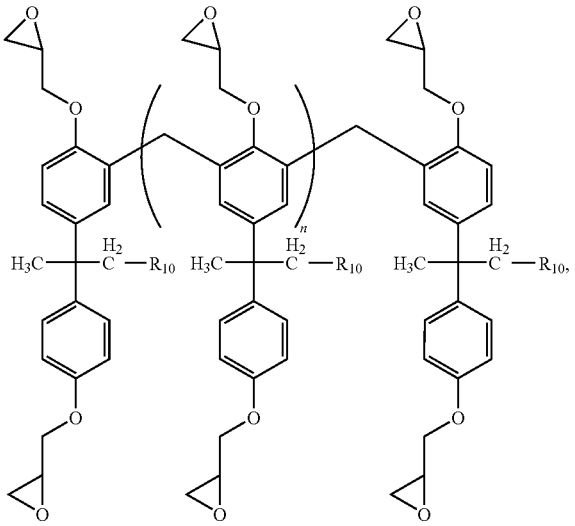

wherein n is an integer in a range of 1 to 20, and wherein $R_{10}$ is a halogen atom, a hydroxy group, a substituted or unsubstituted $C_1$-$C_{20}$ alkyl group, a substituted or unsubstituted carboxyl group, or a substituted or unsubstituted $C_1$-$C_{20}$ alkylsiloxane group.

14. The method of claim 11, wherein the first negative photoresist composition and the second negative photoresist composition each comprises about 1 to about 10 parts by weight of the cationic optical initiator and about 30 to about 300 parts by weight of the solvent based on 100 parts by weight of the epoxidized multifunctional bisphenol B novolak resin.

15. The method of claim 11, further comprising, before the forming of the chamber layer on the substrate:

forming an insulation layer on the substrate;

sequentially forming at least one heater and at least one electrode on the insulation layer; and forming a passivation layer so as to substantially cover the plurality of heaters and electrodes.

16. The method of claim 15, further comprising forming an anti-cavitation layer on the passivation layer.

17. The method of claim 11, further comprising, before the forming of the chamber layer on the substrate step, forming a glue layer on the substrate.

18. A method of manufacturing an inkjet printhead, the method comprising:

providing a substrate;

providing at least one chamber material layer above the substrate, the chamber material layer comprising a first negative photoresist composition comprised of an epoxidized multifunctional bisphenol B novolak resin, a cationic optical initiator, and a solvent;

forming at least one exposure portion of the chamber material layer and at least one non-exposure portion of the chamber material layer;

forming at least one chamber layer having at least one ink chamber by removing the non-exposure portion;

forming at least one nozzle material layer above the chamber layer, the nozzle material layer comprising at least one second photoresist composition comprised of an epoxidized multifunctional bisphenol B novolak resin, a cationic optical initiator, and a solvent;

forming at least one exposure portion of the nozzle material layer and at least one non-exposure portion of the nozzle material layer;

forming at least one nozzle layer having at least one nozzle in communication with the chamber by removing the non-exposure portion; and forming at least one ink feed passage in the substrate such that the ink feed passage is in communication with the at least one chamber.

19. The method of claim 18, wherein the epoxidized multifunctional bisphenol B novolak resin is represented by Formula 1 below:

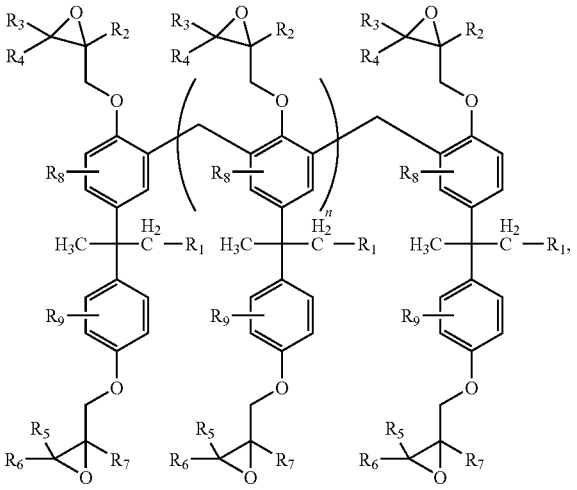

wherein n is an integer in a range of 1 to 20, wherein $R_1$ is a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group, and wherein $R_2$ through $R_9$ are each independently a hydrogen atom, a halogen atom, a hydroxy group, an amino group, a nitro group, a cyano group, a substituted or unsubstituted $C_1$-$C_{20}$ alkyl group, a substituted or unsubstituted $C_1$-$C_{20}$ carboxyl group, a substituted or unsubstituted $C_1$-$C_{20}$ alkylsiloxane group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group.

20. The method of claim 18, wherein the epoxidized multifunctional bisphenol B novolak resin is represented by Formula 2 below:

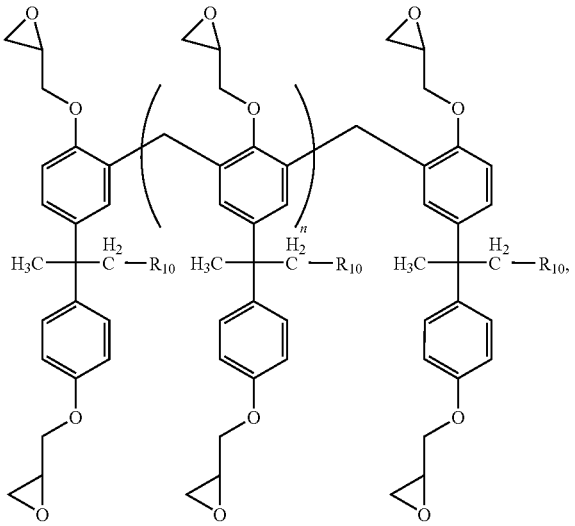

wherein n is an integer in a range of 1 to 20, and wherein $R_{10}$ is a halogen atom, a hydroxy group, a substituted or unsubstituted $C_1$-$C_{20}$ alkyl group, a substituted or unsubstituted $C_1$-$C_{20}$ carboxyl group, or a substituted or unsubstituted $C_1$-$C_{20}$ alkylsiloxane group.

* * * * *

UNITED STATES PATENT AND TRADEMARK OFFICE

CERTIFICATE OF CORRECTION

PATENT NO. : 8,147,037 B2
APPLICATION NO. : 12/565038
DATED : April 3, 2012
INVENTOR(S) : Byung-Ha Park et al.

It is certified that error appears in the above-identified patent and that said Letters Patent is hereby corrected as shown below:

In the Claims:

Column 18; Line 26; In Claim 3, delete "carboxyl" and insert -- $C_1$-$C_{20}$ carboxyl --, therefor.
Column 18; Line 38; In Claim 6, delete "cyclopentanon," and insert -- cyclopentanone, --, therefor.
Column 19; Line 49 (Approx.); In Claim 12, delete "$R_1$" and insert -- $R_2$ --, therefor.
Column 20; Line 26; In Claim 13, delete "carboxyl" and insert -- $C_1$-$C_{20}$ carboxyl --, therefor.

Signed and Sealed this
Fourteenth Day of May, 2013

Teresa Stanek Rea
*Acting Director of the United States Patent and Trademark Office*